US007399110B2

(12) United States Patent
Cheng

(10) Patent No.: US 7,399,110 B2
(45) Date of Patent: Jul. 15, 2008

(54) DECORATIVE LIGHT SYSTEM

(75) Inventor: Chung-wai (Paul) Cheng, Mid-Levels (HK)

(73) Assignee: Cindex Holdings Limited (A Hong Kong Corporation), Kowloon Bay (HK)

( * ) Notice: Subject to any disclaimer, the term of this patent is extended or adjusted under 35 U.S.C. 154(b) by 0 days.

(21) Appl. No.: 11/564,109

(22) Filed: Nov. 28, 2006

(65) Prior Publication Data

US 2007/0121321 A1 May 31, 2007

Related U.S. Application Data

(60) Provisional application No. 60/740,212, filed on Nov. 28, 2005.

(51) Int. Cl.
*H01R 33/00* (2006.01)

(52) U.S. Cl. ..... 362/654; 362/647

(58) Field of Classification Search ..... 362/252, 362/227, 655–656, 647, 653–654, 121–124, 362/806–809

See application file for complete search history.

(56) References Cited

U.S. PATENT DOCUMENTS 5,779,352 A * 7/1998 Lin ..... 362/249
5,816,686 A * 10/1998 Wang et al. ..... 362/653
5,924,786 A * 7/1999 Lin ..... 362/249
6,502,958 B1 * 1/2003 Chen ..... 362/252
6,854,863 B2 2/2005 Wu
2004/0174708 A1 * 9/2004 Wu ..... 362/296
2004/0179375 A1 * 9/2004 Chen ..... 362/565
2006/0274556 A1 12/2006 Massabki et al.

* cited by examiner

*Primary Examiner*—Jong-Suk (James) Lee
*Assistant Examiner*—Julie A. Shallenberger
(74) *Attorney, Agent, or Firm*—Ryan A. Schneider, Esq.; Seyed Kaveh E. Rashidi-Yazd, Esq.; Troutman Sanders LLP

(57) ABSTRACT

A decorative light system includes a frame assembly, a background assembly, and a light assembly. The frame assembly includes a frame, which is the skeletal framework of the light system. The background assembly includes a reflective surface and a support member; the reflective surface provides a reflective decorative background and the support member supports reflective surface, if need be, and the light assembly. The light assembly includes a plurality of bulb assemblies and attendant wiring, each bulb assembly having a light source and a socket. Each bulb assembly is inserted through a slit/aperture in the background assembly, and is positioned approximately parallel to the reflective surface of the background assembly providing a flat profile.

17 Claims, 11 Drawing Sheets

DECORATIVE LIGHT SYSTEM

CROSS REFERENCE TO RELATED APPLICATION

This application claims benefit, under 35 U.S.C. § 119(e), of U.S. Provisional Application Ser. No. 60/740,212, filed 28 Nov. 2005, the entire contents and substance of which are hereby incorporated by reference.

BACKGROUND

1. Field of the Invention

The present invention relates to a light system and, more particularly, to a decorative light system.

2. Description of Related Art

Light systems are widely used in holidays, festivals, and celebrations. Conventionally, lights systems are arranged, for example, on a tree, door, or otherwise around the outside of a house during a holiday season. Christmas lights are commonly known. For more versatile decorating purposes, various decorative light systems are disclosed in the prior art.

FIGS. 1A-1B are views of a prior art consumer products commercially available. This conventional decorative light system 5 includes a background decoration of two candy canes tied together by a bow, wherein the decoration is lined at various points with lights.

This conventional decorative light system 5 includes a plurality of bulb assemblies 10, generally about the perimeter of the decoration. The bulb assemblies 10 include a light bulb 15 housed in a light socket 20. Each light socket 20 is connected to a power source along a series-arranged light string 25, and is adapted to provide power to illuminate the light bulbs 15.

As shown in FIGS. 2A-2B this conventional decorative light system 5 is arranged such that the plurality of light bulbs 15 are inserted through a plurality of holes 30, and the background decoration preferably includes elements of a reflective material 35. Light system 5 hides the light socket 20, as it is positioned out of sight from the front of the product, behind the reflective material 35. The light bulbs 15 are inserted through the reflective material 35, and thus are viewable. In this arrangement, the light bulbs 15 of a conventional decorative light system 5 are positioned normal to the surface of the reflective material 35. Indeed, the socket 20 and hole 30 of the conventional system cooperate to maintain the bulbs normal the material 35.

Yet, disadvantageously, this arrangement minimizes reflection of light from the material and exposes the light bulbs to potential hazards, such as heavy snow and leaves.

Therefore, it can be seen that a need yet exists for an improved decorative light system. It is to such a device and method that the present invention is directed.

BRIEF SUMMARY OF THE INVENTION

Briefly described, the present invention comprises a decorative light system including a frame assembly, a background assembly, and a light assembly. The frame assembly can comprise a frame, which generally is a skeleton or support framework for the background and light assemblies. The background assembly can comprise a reflective surface and support member; the reflective surface to provide a reflective decorative background, and the support member to support the light assembly to the frame assembly, and if necessary, support the reflective surface. The light assembly can comprise wiring, a plurality of bulb assemblies, each comprising a socket system, and a light source to illuminate the light system.

A method of installing the light assembly through and upon the background assembly is further described. A plurality of breaches positioned through the reflective surface can receive each bulb assembly. A light source of the bulb assembly is first inserted into the breach (or aperture) and then the socket of the light assembly enters the breach. The bulb assembly is then inserted through the breach, wherein a pair of terminal wires of the light assembly is hidden from view.

An extending member from the socket assembly can then be inserted into an extending member breach in the background assembly. The present bulb assembly is preferably angled toward the background assembly, away from the prior art normal/perpendicular orientation. Thus, the bulb assembly essentially lies upon the background assembly providing for a flatter profile, and more reflected light than produced by the conventional system. Accordingly, the bulb assembly can be positioned in a range from parallel through slightly less-than-perpendicular to the surface of the reflective device.

The extending member when locked in the extending member breach locks the bulb assembly to an approximately parallel arrangement to the background assembly. In addition, the extending member can receive and/or grip a pair of terminal wires of the light assembly, further locking the bulb assembly to the background assembly Because the socket assembly of the light assembly is exposed to a viewer, the socket assembly can be wrapped with a cover having the attributes of the background assembly. In particular, the cover can have the same color and/or texture as the reflective surface, for blending with the background assembly.

These and other objects, features, and advantages of the present invention will become more apparent upon reading the following specification in conjunction with the accompanying drawings.

DETAILED DESCRIPTION

To facilitate an understanding of the principles and features of the invention, it is explained hereinafter with reference to its implementation in an illustrative embodiment. In particular, the invention is described in the context of being a decorative light system.

Figure 3A:
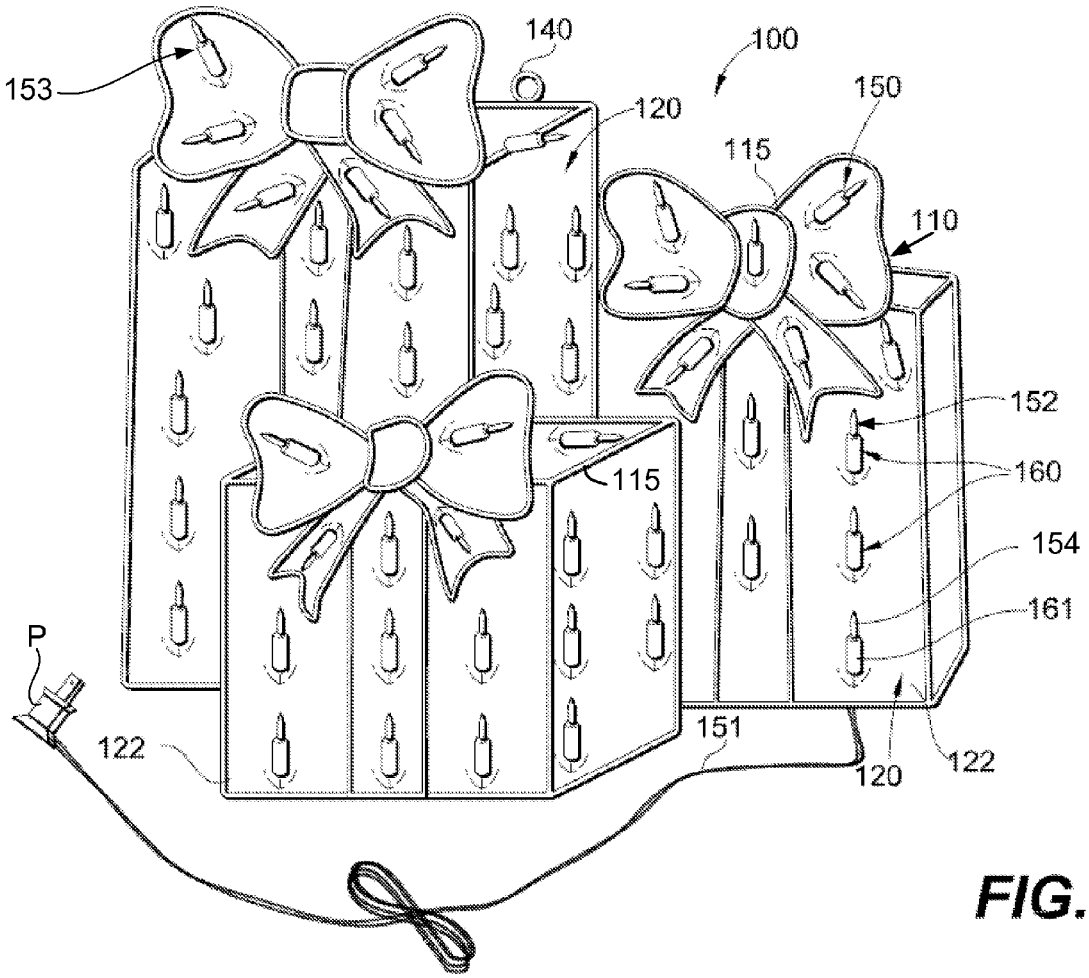
FIG. 3A is a front view of a decorative light system, in accordance with a preferred embodiment of the present invention
Figure 3B:
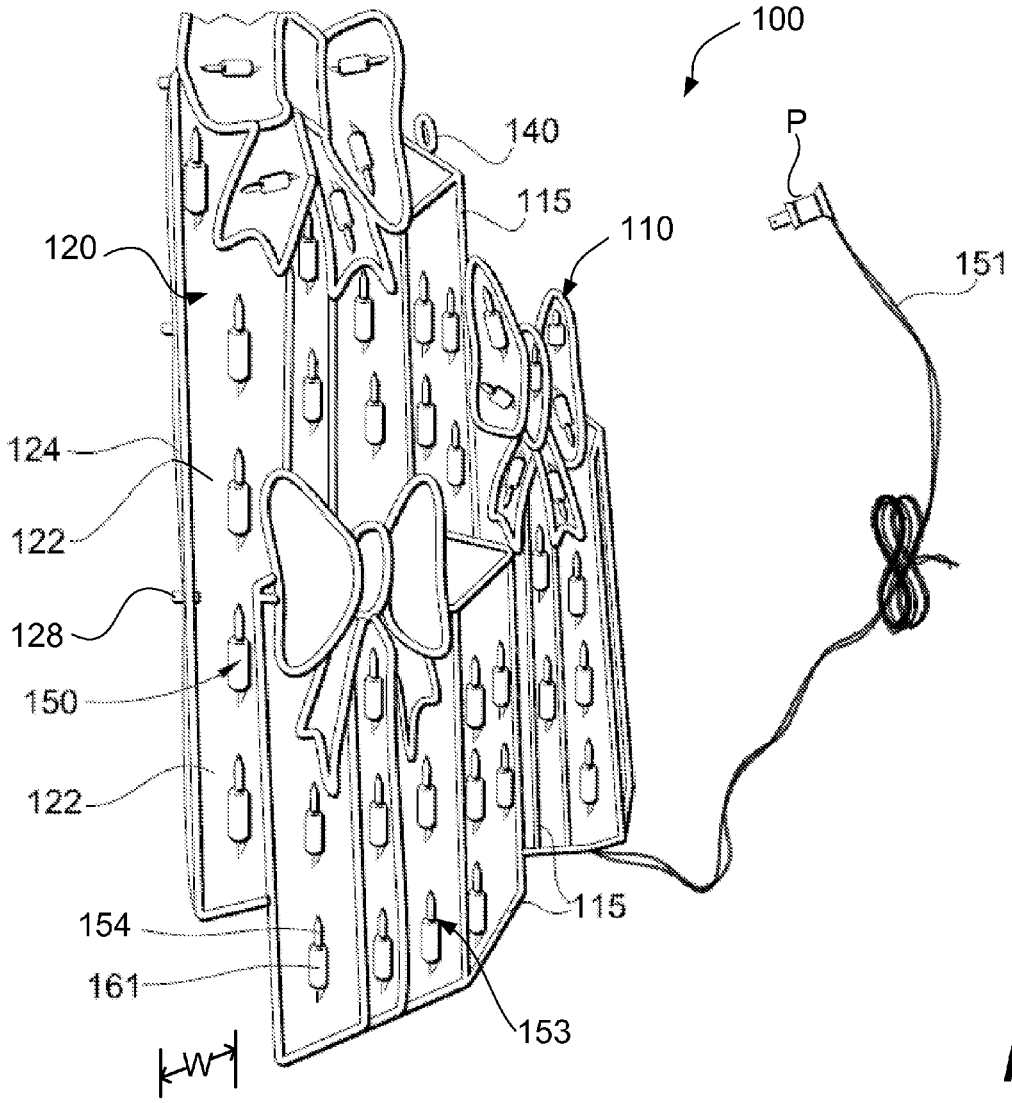
FIG. 3B is a side, perspective view of the decorative light system, in accordance with a preferred embodiment of the present invention.

As shown in FIGS. 3A-3B, the present invention is a decorative light system 100. The light system 100 comprises a frame assembly 110, a background assembly 120, and a light assembly 150.

The frame assembly 110 comprises a frame 115, which is the skeletal framework of the light system 100. The background assembly 120 comprises a reflective surface 122 to provide a reflective decorative background, and a support member 124 to support the light assembly 150 from behind the light system 100, generally out of view. The light assembly 150 comprises a plurality of bulb assemblies 153 and attendant wiring 151, each bulb assembly 153 generally including a light source 152 and a socket assembly 160 to illuminate the light system 100.

Typically, the decorative light system 100 can provide decoration, because people enjoy decorating in the spirit of the holidays. As illustrated in FIG. 3A, a number of gifts with bows can be an exemplary decorative light system 100 for a holiday, for example Christmas. The following is a list, not to be exhaustive but only illustrative, of potential decorative light system designs: gifts, candy cane(s), Santa Claus, snowman, reindeer, Christmas tree(s), North Pole, elf, manger, cross, ornament, sled, holly, bells, stockings, star, candles, sack of gifts, wreath, mistletoe, and the like.

Christmas, however, is not the only holiday for which the decorative light system 100 can be designed. The holiday of Halloween can include decorative light systems 100, for example, illustrating black cat(s), ghost(s), witch(es), bat(s), pumpkin(s). The holiday of Thanksgiving can include decorative light systems 100, for instance, turkey, cornucopia, pilgrims, Indians, ships, and the like. Still other events, such as Independence Day, birthdays, and Easter can provide decorative light systems. Other examples can include flags (countries, sports teams, states, and the like) and spelled-out words ("Happy Birthday," and "Congratulations"). The light system 100 is capable of both use indoors and outdoors. One skilled in the art would appreciate that the decorative light system 100 can include many decorations.

A beneficial feature of the decorative light system 100 is its substantially flat arrangement. An exemplary width W (FIG. 3B) of the decorative light system 100 is less than 0.75 inches.

Again referring to FIGS. 3A-3B, the frame assembly 110 includes the frame 115. The frame 115 provides a relatively rigid border and shape that is a skeletal support to the decorative light system 100. The outside border of the frame 115 can be dependent on the overall shape of the decorative light system 100. The skeleton (interior framework) of the frame 115 can be dependent on the design of the background assembly 120, used not only to provide proper support, but also to set off different sections of the overall design from one another.

The frame 115 can be made of a metal, plastic, and the like to provide the stability needed for the decorative light system 100 to maintain its decorative shape. Preferably, the frame 115 is white, but can be many alternative colors. As discussed, the frame 115 need not be limited only to the border/perimeter of the design, but used internally not only to provide further rigidity, but also to aid in differentiation of color/designs, among sections. For instance, FIGS. 3A-3B illustrate one embodiment of three gifts with bows. Portions of the frame 115 provide transition, displaying a three-dimensional depth of the gifts, and also provide borders of the design along color changes.

The frame assembly 110 can include one or more a hanging devices 140, preferably an encircling member or a hook, enabling hanging, mounting, or suspending the decorative light system 100.

In alternative embodiments, the frame 115 can be positioned wholly behind the reflective surface 122, such that minimal portions, if at all, are viewable. In such embodiments, the frame 115 provides the needed support, but does not interfere with the viewing of the decorative light system 100.

The background assembly 120 provides both the background (the "look") of the decorative light system 100, and the support mechanism of the light assembly 150 of the light system 100. The background assembly 120 can include one or more portions that are at least somewhat reflective of light. These reflective surfaces 122 can include a reflective sheet, a number of reflective stickers, a hologram, holographic colored sheets of paper, and the like. The reflective surface 122 reflects light. The entire decoration need not be comprises fully of reflective surfaces 122.

The background assembly 120 further includes a support member 124 positioned behind the reflective surface 122 to provide support of the light assembly 150 to the decorative light system 100. The support member 124 can also support the reflective surface 122, should it not have, itself, the integrity needed to be self supporting. For example, the support member 124 can be made of cardboard, aluminum, or like relatively flat surface to provide additional support for a non-self-supported reflective surface 122. The reflective surface 122 can be adhered to the support member 124 by many schemes. For instance, the reflective surface 122 and/or support member 124 can be secured to the frame 115 by a securing mechanism 128, such as twist ties, zip ties, and the like. The reflective surface 122 can also be adhered to the support member 124 by many adhesives, such as glue, sealants, resins, bonding agents, and the like.

Figure 5A:
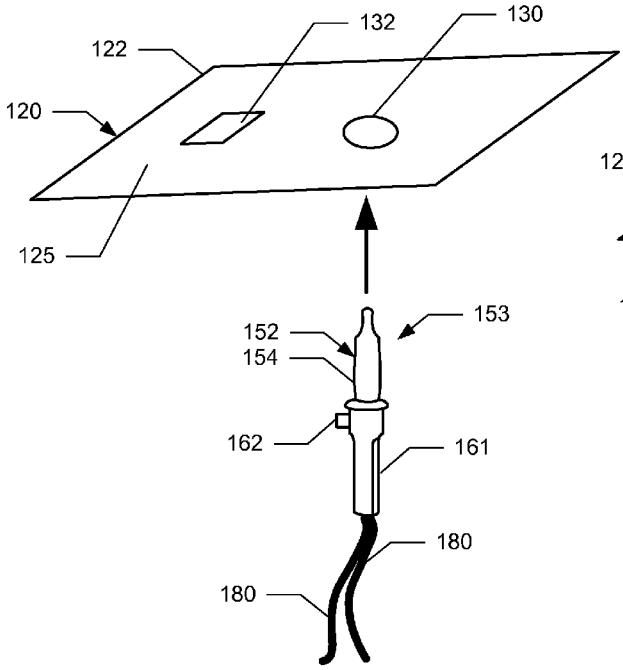
FIGS. 5A-5D are perspective views of a top surface of a background assembly illustrating installation of the bulb assembly in the decorative light system, in accordance with preferred embodiments of the present invention.

The background assembly 120 further has a plurality of predetermined positioned apertures 130 through the surface 122/support member 124 to receive bulb assemblies 153. The apertures 130 of the background assembly 120 are cooperatively shaped to receive the bulb assembly 153. Although aperture 130 can include a loss of surface material, for example as shown in FIG. 5A, preferably the aperture 130 can also simply be a breach in the surface 122/member 124, such as cut lines A-A shown in FIG. 5C, wherein the passage from behind the decoration to the front of the decoration is through the cut lines/slit A-A (such that there is minimal-to-no loss of surface material). In one embodiment, only one slit is provided. In other embodiments, more than one slit is provided. The length and orientation of the slit(s) will be accommodating to the profile of the bulb assembly 153. Additionally, the background assembly 120 can have an extending member aperture 132 (or slit arrangement 132), which is described in detail hereinafter.

The decorative light system 100 of the present invention further includes a light assembly 150. The light assembly 150 includes the bulb and wiring of the system. It can include at least one light string system 151 with a plug P. The light string system 151 is, preferably, electrically series-connected.

Figure 4A:
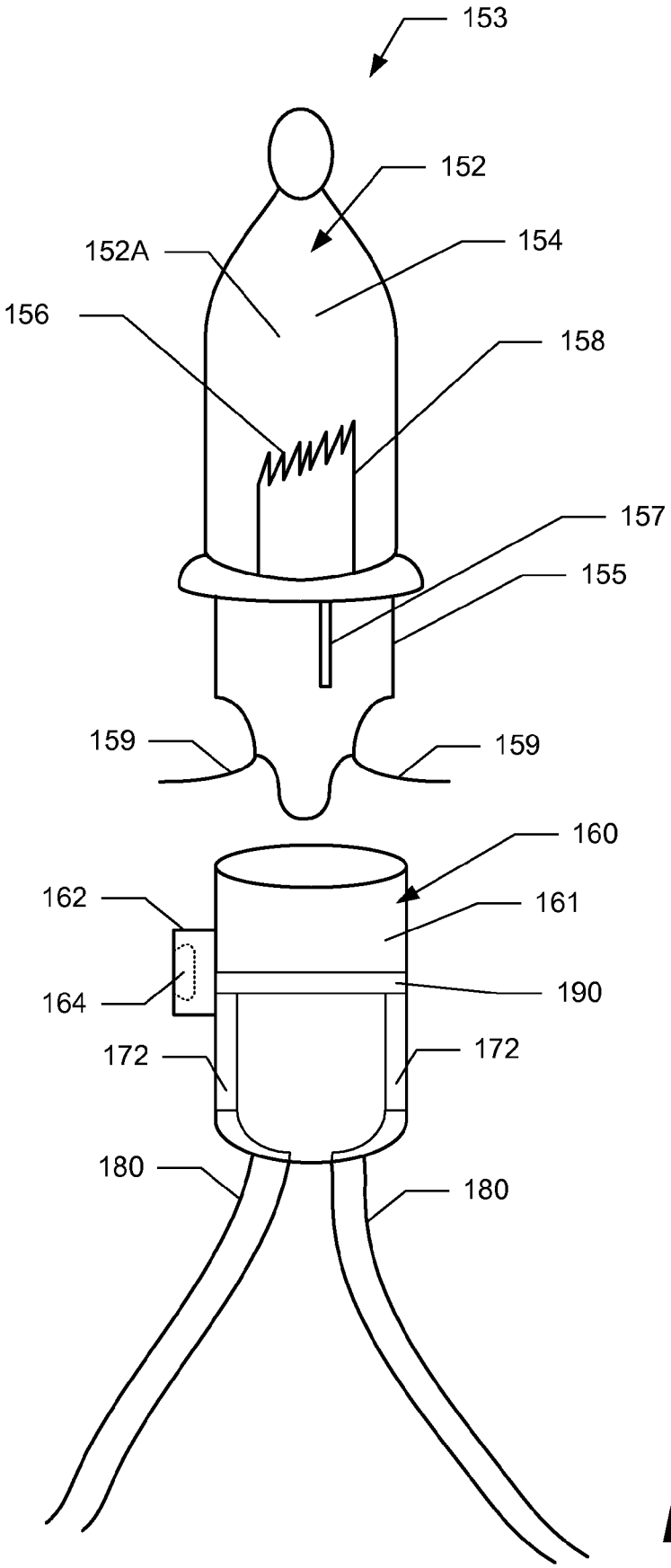
FIG. 4A is a side, partial perspective view of a bulb assembly of the decorative light system, in accordance with a preferred embodiment of the present invention.
Figure 4B:
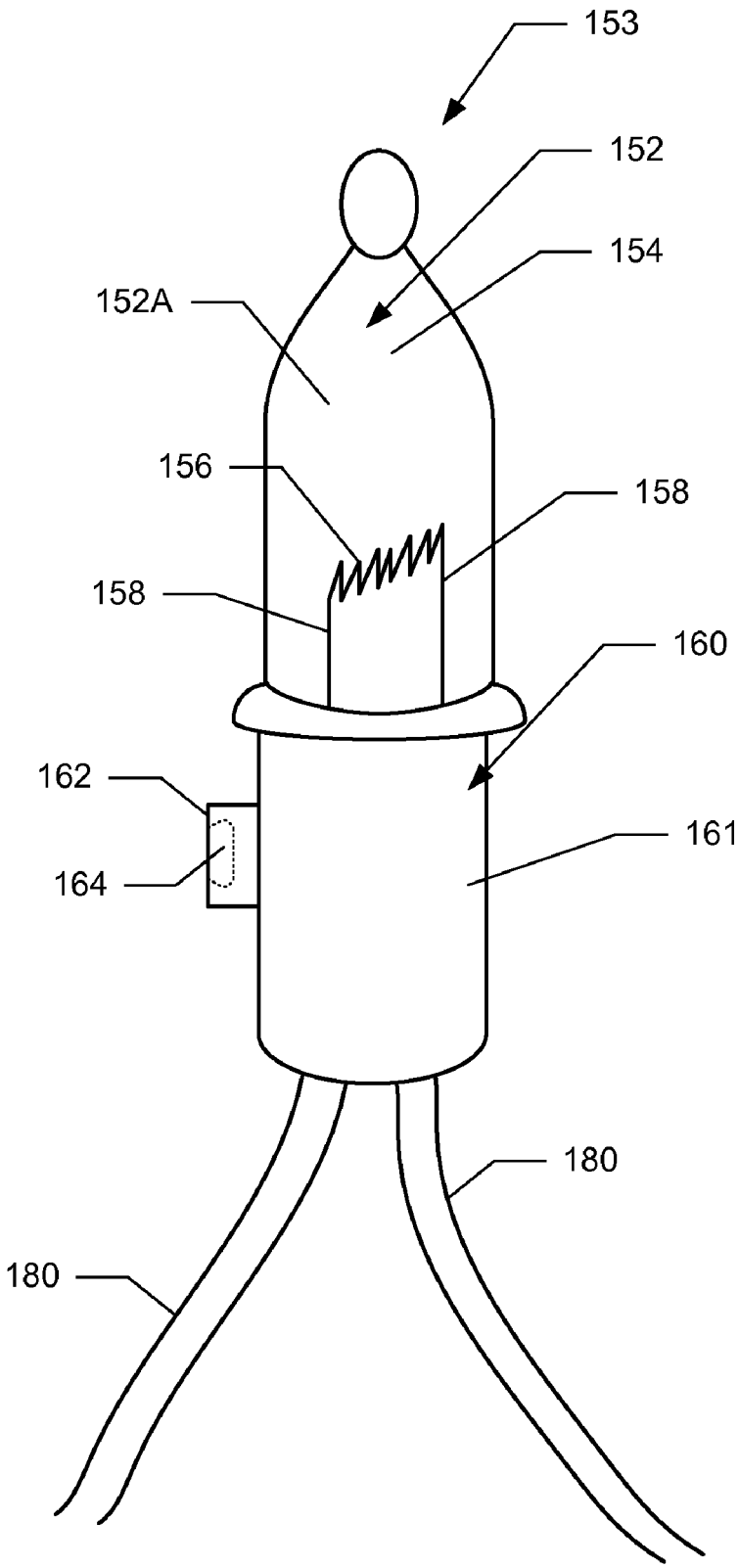
FIG. 4B is a side, partial perspective view of the bulb assembly of the decorative light system of FIG. 4A, wherein the light bulb is seated in the socket assembly, in accordance with a preferred embodiment of the present invention.

Referring now to FIGS. 4A-4B, the light assembly 150 comprises a plurality of bulb assemblies 153, each bulb assembly 153 including a light source 152, a base 155, and a socket assembly 160. The light source 152 provides light when energized. One skilled in the art can appreciate that the light source 152 can be many types of light sources, including a light bulb, light emitting diode (LED), incandescent lamp, halogen lamp, fluorescent lamp, and the like. In a preferred embodiment, the light source 152 is a light bulb 152A. The bulb assembly 153 can include a shunting device 190 to keep a light string system 151 illuminated, even if one of its bulbs 152A burns out.

The light bulb 152A can include a globe 154 and a filament 156. The globe 154 is in communication with, and terminates at, the base 155. The globe 154 can be made of conventional translucent or transparent material such as plastic, glass, and the like. Typically, the globe 154 includes a hollow interior enabling protection of the filament 156. In a preferred embodiment, the color of the globe 154 matches or is similar to the color of the reflective surface 122. That is, the color of the globe 154 can be similar to the color of the reflective surface 122, for which the globe 154 is in front of, from the vantage of viewing the globe 154.

The filament 156, when charged with energy, can illuminate the light bulb 152A. Conductors 158 can be in electrical communication with the filament 156. The conductors 158 enable energy into the light bulb 152A to illuminate the filament 156, and thus the light bulb 152A The conductors 158 extend down through the base 155, wherein preferably the conductors 158 can be in communication with a pair of lead wires 159 external the base 155. The lead wires 159 extend through a bottom of the base 155, and are a pair of wires wrapped around the base 155 extending upwardly in the direction of globe 154, adjacent the base 155.

The bulb assembly 153 further includes the base 155. The base 155 can be integrally formed with the light source 152. The base 155 can be a unitary element of the light bulb 152A, or a separate element. Preferably, the base 155 communicates between the light bulb 152A and an associated socket 161 of the socket assembly 160, complimenting and facilitating the seating of the light bulb 152A to the socket 161. The base 155 can incorporate at least one ridge 157 to ensure a snug fit with the socket 161, preventing the accidental disengagement of the light bulb 152A from the socket assembly 160. Other mechanical means can be used with the base 155 and the socket assembly 160 to ensure a tight fit.

The socket assembly 160 comprises the socket 161 adapted to receive the light bulb 152A/base 155. The socket 161 defines a cooperatively-shaped aperture to receive the base 155 of the bulb assembly 153. The socket 161 can be arranged in many shapes and sizes, but as one skilled in the art will recognize, the socket 161 should be of a shape to conveniently receive the light bulb 152A/base 155.

The socket 161 includes a pair of socket terminals 172. The socket terminals 172 are, preferably, located on opposing inner sides of the socket 161. The socket 161 further includes a pair of terminal wires 180 extending to the exterior to allow energy to enter (and exit) the socket 161. Each socket terminal is, essentially, an extension of each respective terminal wire 180. The terminal wire 180 extends through the bottom of the socket 161 and is ultimately connected to an electrical source.

Light strings, such as the decorative light string system 100, are typically arranged with bulb assemblies 153 on the strings being electrically connected in series, rather than in a parallel arrangement. Unfortunately, there are disadvantages to designing a light string in series. When even a single light bulb is removed from a socket, the entire series of lights is rendered inoperable. Because each light bulb within its respective socket completes the electrical circuit, when a light bulb is removed or the filament of the bulb burns out, a gap is created in the circuit; that is, an open circuit is formed. Thus, electricity is unable to continue to flow through the circuit.

To overcome this dilemma, the socket assembly 160 can include a shunting device 190 to enable the energy flowing through the light string system 151 to continue to flow even when a light source 152 is absent from the socket 161. For instance, the light bulbs 152A in the light assembly 150 will remain illuminated even though there may exist: an open filament 156, for example, a dead bulb 152A, faulty or damaged bulb 152A, faulty socket 161, or simply because the bulb 152A is not properly mounted in its respective socket 161, or is entirely removed or falls out of its respective socket 161. For instance, the bypass activating system described in Massabki et al., U.S. Ser. No. 11/473,504, filed Jun. 23, 2006, the entire disclosure of which is incorporated herein by reference, can be used as the shunting device 190.

The socket assembly 160 can include an extending member 162, which is external to the socket 161. Upon light installation of the decorative system 100, the extending member 162 being sufficiently sized, can be secured into an extending member slit/aperture 132 of the background assembly 120. The extending member aperture 132 is positioned adjacent to the slit/aperture 130, enabling the further securing of the bulb assembly 153 to the decorative light system 100. In a preferred embodiment, the extending member 162 is approximately the same width as the diameter of the socket 161. The extending member 162, in a preferred embodiment, can also include a loop or grip 164. The grip 164 is sufficiently sized to secure at least two terminal wires 180.

Figure 5B:
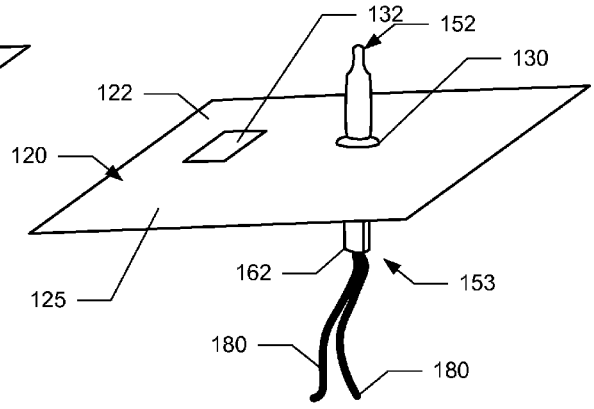
Figure 5C:
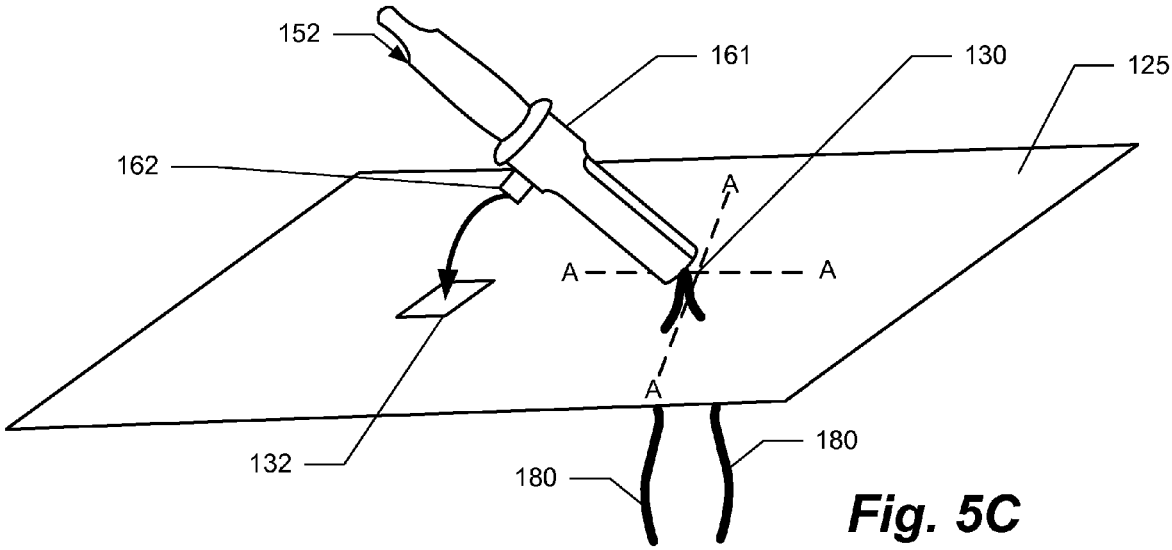

As shown in FIGS. 5A-5F, a top surface 125 of the background assembly 120 is illustrated, wherein a method of installing the bulb assembly 153 through and upon the background assembly 120 is further illustrated. FIG. 5A illustrates the aperture 130 to receive the bulb assembly 153. The globe 154 of the bulb assembly 153 is first inserted into the aperture 130 of the background assembly 120. Accordingly, the socket 161 next enters the aperture 130 of the background assembly 120, as illustrated in FIGS. 5B-5C. The bulb assembly 153 is then fully inserted through the aperture 130, including the socket 161 and extending member 162.

Figure 1A:
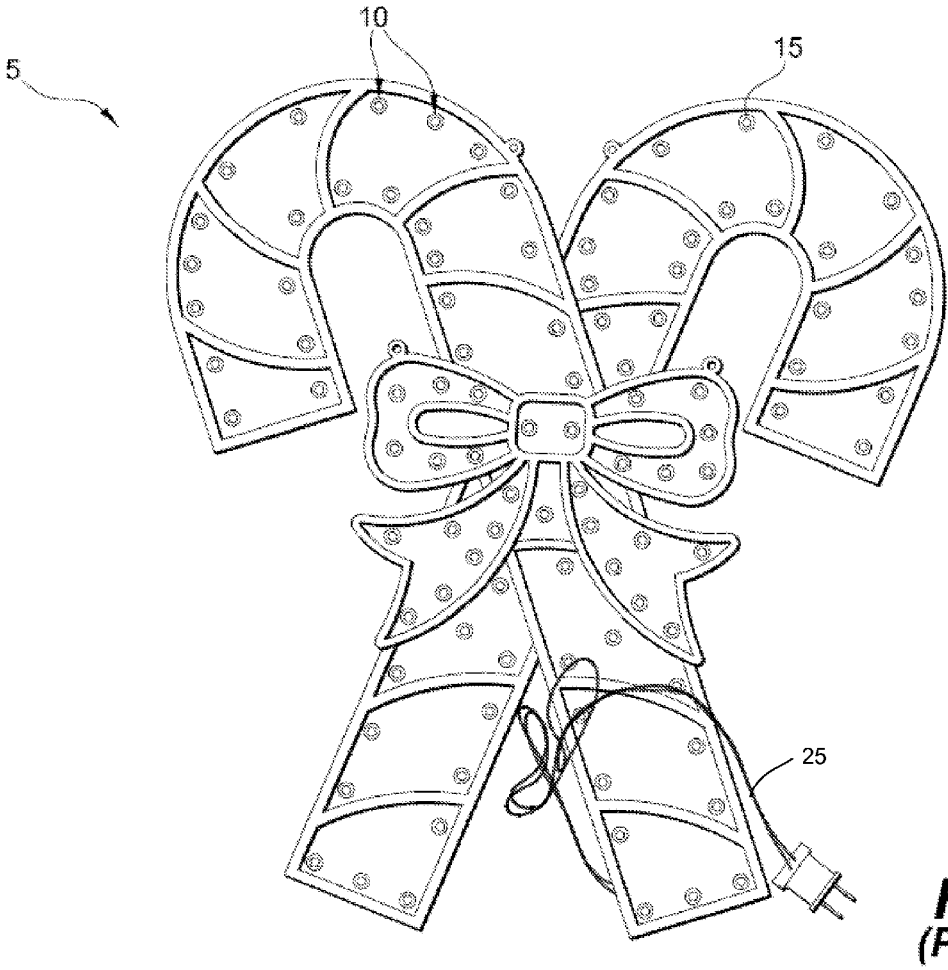
FIG. 1A (PRIOR ART)
FIG. 1A is a front view of a conventional decorative light system.
Figure 1B:
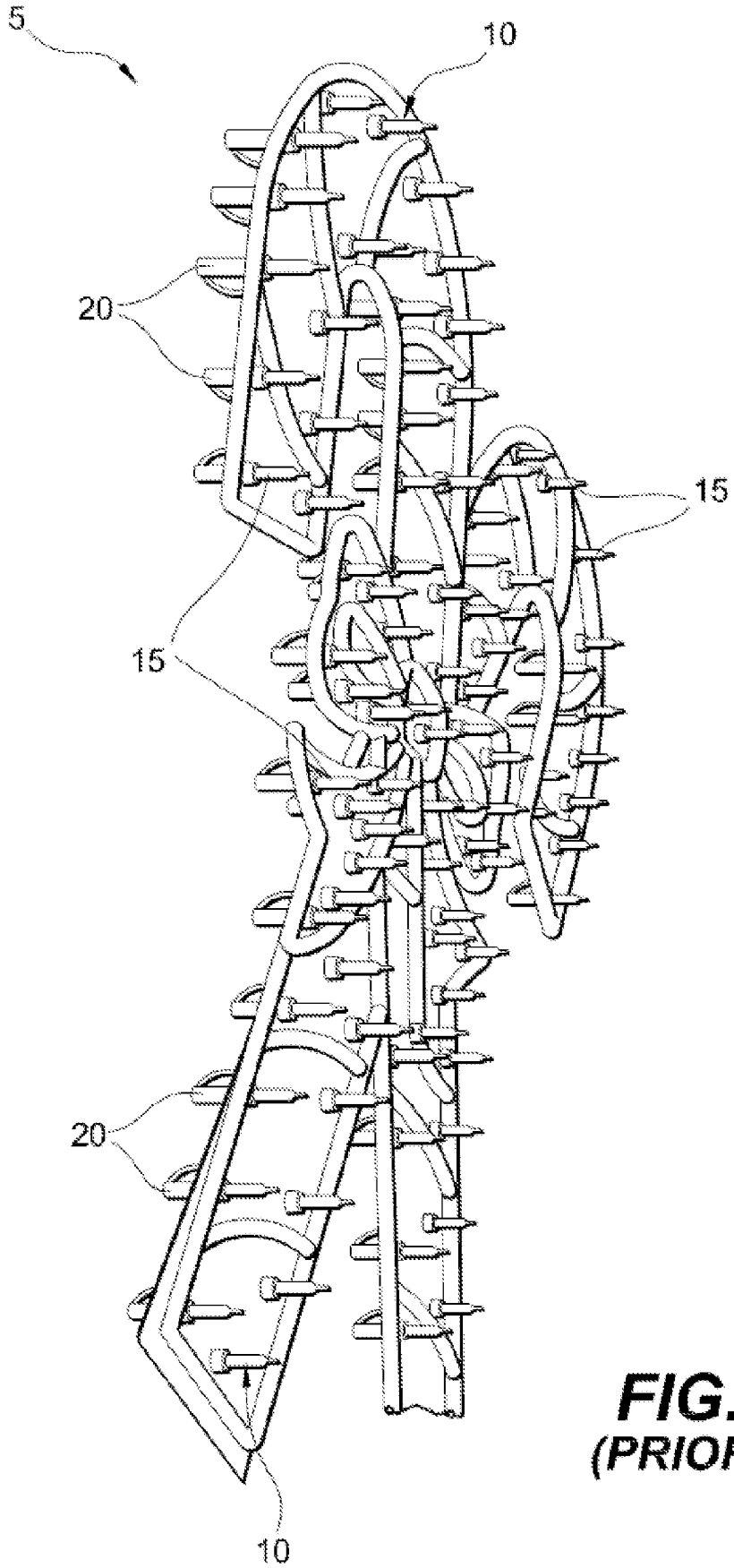
FIG. 1B (PRIOR ART)
FIG. 1B is a side, perspective view of the conventional decorative light system of FIG. 1A.
Figure 2A:
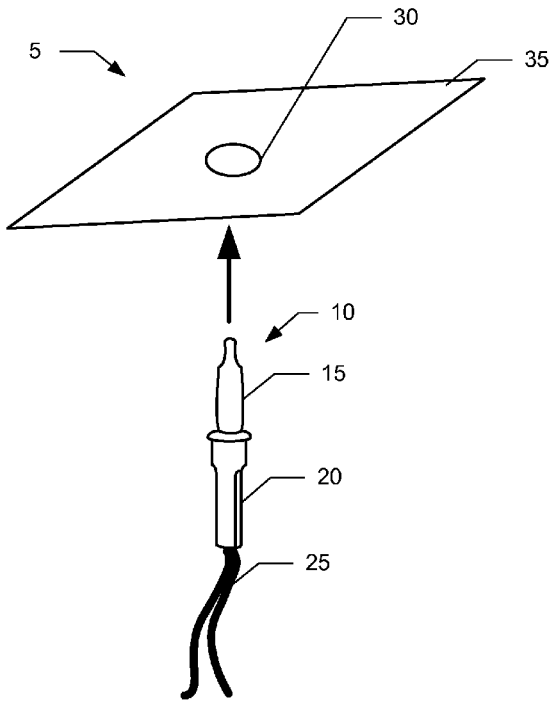
Fig. 2A (Prior Art)
FIG. 2A is a perspective view of the installation of a light assembly in the conventional decorative light system of FIGS. 1A and 1B.
Figure 2B:
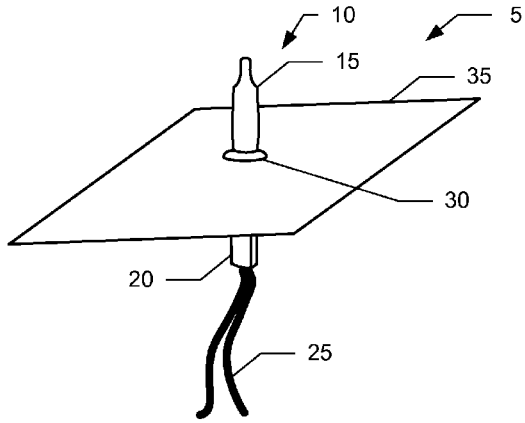
Fig. 2B (Prior Art)
FIG. 2B is a perspective view of the installed light assembly in the conventional decorative light system of FIGS. 1A, 1B, and 2A.

The extending member 162 can then be inserted into the extending member aperture 132. Not unlike aperture 130, extending member aperture 132 can be slits. As illustrated in FIG. 5C, the light assembly 150 is angled (as illustrated by the arrow) toward the background assembly 120 away from the conventional art of being normal to the top surface 125 (see FIGS. 1B and 2B). In the present invention, the bulb assemblies 153 are preferably more parallel to the top surface 125, than normal the top surface 125. More preferably, the bulb assemblies 153 are parallel to the top surface 125.

Figure 5D:
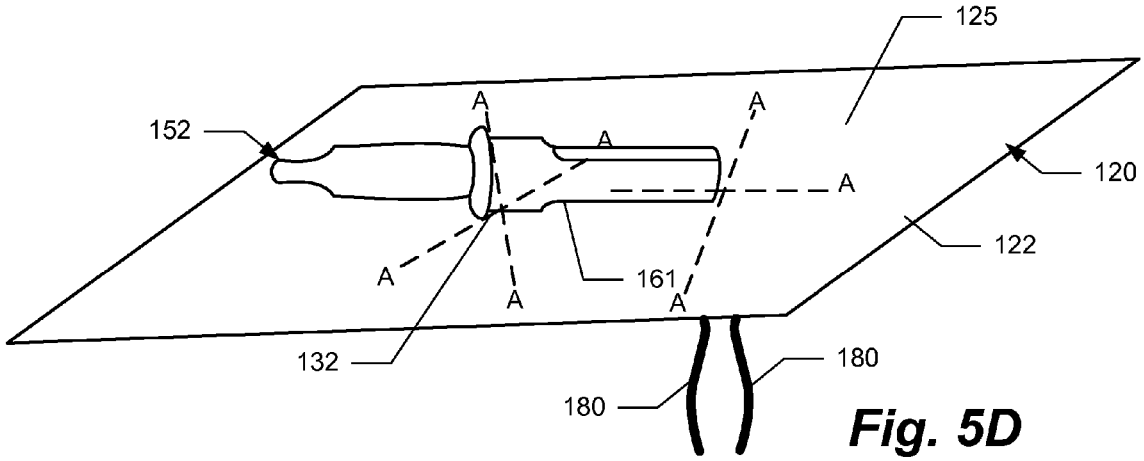

The bulb assembly 153 can essentially lie upon the background assembly 120, as shown in FIG. 5D. The bulb assembly 153 can indeed be positioned parallel to the surface of the reflective surface 122. That is, the bulb assembly 153 can be co-planar to the reflective surface 122 (see also FIG. 3B). Such an orientation of bulb to surface provides more reflected light than the prior art, and is thus more visually appealing.

The extending member 162 when locked in the extending member aperture (or breach) 132 locks the bulb assembly 153 to an approximately parallel arrangement to the background assembly 120. In addition, the extending member 162 can receive and/or grip a pair of terminal wires 180 of the light assembly 150, further locking the bulb assembly 153 to the background assembly 120.

Figure 5E:
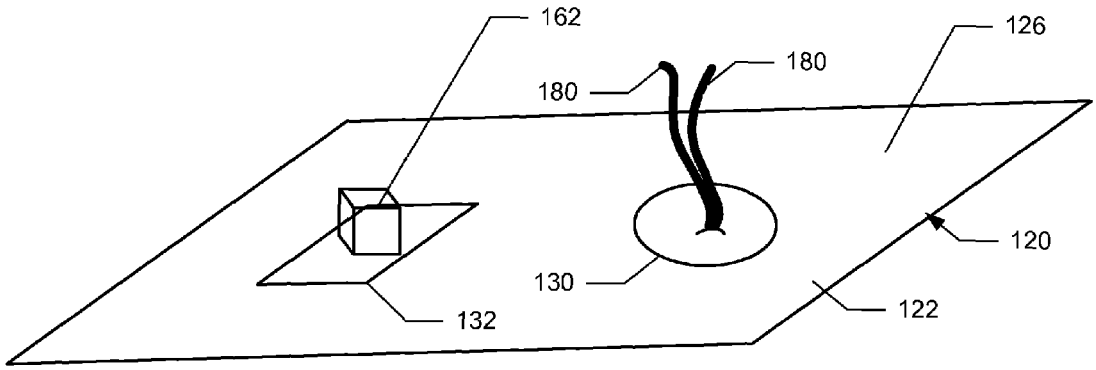
FIGS. 5E-5F are perspective views of a bottom surface of the background assembly illustrating installation of the bulb assembly in the decorative light system, in accordance with preferred embodiments of the present invention.
Figure 5F:
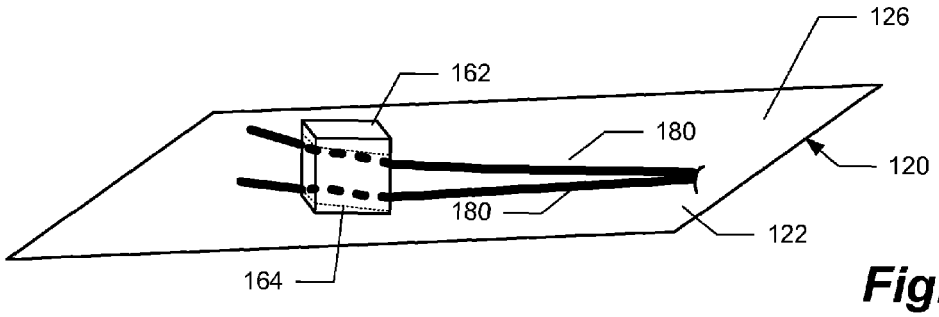
Figure 6A:
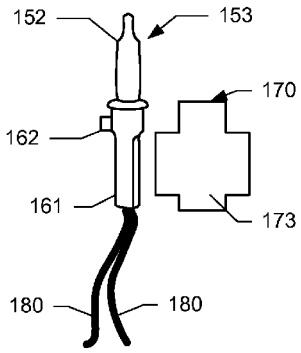
FIGS. 6A-6D are side views of installation of a cover around a socket of the bulb assembly, in accordance with a preferred embodiment of the present invention.
Figure 6B:
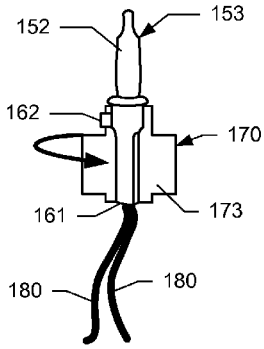
Figure 6C:
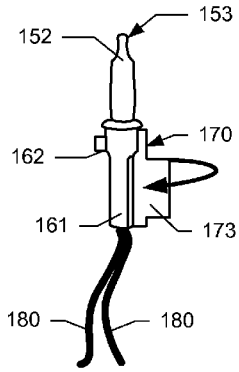
Figure 6D:
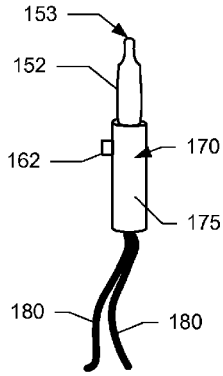

A bottom surface 126, or backside, of the background assembly 120 is illustrated in FIGS. 5E-5F. FIG. 5E depicts the wires 180 extending from the aperture 130, as well as the extending member 162 extending through the extending member aperture 132. The wires 180 are secured in the grip 164, as shown in FIG. 5F. When the wires 180 are received by the grip 164, the bulb assembly 153 is further secured to the background assembly 120.

FIGS. 6A-6D depict a method of securing the cover 170 about the socket assembly 160. As described, the bulb assembly 153 and socket assembly 160 are inserted through the aperture 130 to lie upon the top surface 125 of the background assembly 120. Accordingly, the light source 152 and socket 161 are exposed to a viewer. In a preferred embodiment, the socket assembly 160 is covered with a cover 170. The cover 170 has two sides—an inner side 173 and an outer side 175. The inner side 173 can have an adhesive to adhere the cover 170 to the socket assembly 160. The outer side 175 can have a reflective surface, similar in color and design to the reflective surface 122. Thus, depending on the color of the reflective surface 122 near the aperture 130, the outer side 175 of the cover 170 has the same attributes. Preferably, the bulb assembly 153 has a globe 154 that has the color of the background assembly 120, and the socket assembly 160 being covered with the cover 170 that has a reflective surface having the same attributes of background assembly 120, which produces a seamless design of the decorative light system 100. The cover 170 can be wrapped around each of the socket assemblies 160. The cover 170 can be installed before or after the bulb assembly 153 and socket assembly 160 are inserted through the background assembly 120.

While the invention has been disclosed in its preferred forms, it will be apparent to those skilled in the art that many modifications, additions, and deletions can be made therein without departing from the spirit and scope of the invention and its equivalents, as set forth in the following claims.

What is claim is:

1. A decorative light system comprising:

a light assembly comprising a plurality of bulb assemblies electrically connected to one another, each of the plurality of bulb assemblies comprising a socket assembly, a light source, and an extending member extending outwardly from the socket assembly; and a background assembly comprising a reflective surface, the background assembly defining a plurality of bulb apertures sized for receiving the bulb assemblies therethrough, and the background assembly defining a plurality of extending member apertures sized for receiving the extending members of the socket assembly therein, wherein the plurality of bulb assemblies are insertable through the plurality of bulb apertures of the background assembly, wherein the extending member of each of the plurality of bulb assemblies are received by the extending member apertures on the reflective surface of the background assembly, and wherein the plurality of bulb assemblies are positioned substantially parallel with the reflective surface of the background assembly.

2. The decorative light system of claim 1, wherein the extending member received by the extending member aperture locks the bulb assembly in the substantially parallel position.

3. The decorative light system of claim 1, wherein the extending member receives a pair of wires of the light assembly on an opposing side of the background assembly for securing the bulb assembly to the background assembly, and for hiding the pair of wires from view.

4. The decorative light system of claim 1, wherein the socket assembly is wrapped with a cover having similar attributes of the background assembly.

5. The decorative light system of claim 4, wherein the cover wrapped about the socket assembly has the same color as the background assembly.

6. The decorative light system of claim 4, wherein the cover wrapped about the socket assembly has the same texture as the background assembly.

7. The decorative light system of claim 1, further comprising a frame assembly having a frame for supporting the background assembly.

8. The decorative light system of claim 7, wherein the frame assembly provides a rigid border and skeleton to the decorative light system.

9. The decorative light system of claim 7, wherein the frame assembly is positioned in front of the background assembly and provides transition between portions of the background assembly.

10. The decorative light system of claim 1, further comprising a support member positioned behind the background assembly for providing additional support, wherein the support member is connected to the background assembly.

11. The decorative light system of claim 1, wherein each of the bulb assemblies include a globe having a characteristic similar to the characteristic of a portion of the background assembly.

12. A method of assembling a decorative light system, the decorative light system comprising a plurality of bulb assemblies, each bulb assembly comprising a light source, a corresponding socket assembly, and an extending member extending outwardly from the socket assembly; and a sturdy background assembly comprising a reflective surface and a plurality of aperture sets, each aperture set including a bulb assembly aperture sized to receive at least one bulb assembly therethrough and an extending member aperture, the method comprising:

inserting a bulb assembly of the plurality of bulb assemblies through the bulb assembly aperture of the background assembly;

rotating the bulb assembly towards the reflective surface of the background assembly; and securing the extending member of the bulb assembly into the extending member aperture on the reflective surface of the background assembly, wherein the bulb assembly is positioned substantially parallel to the reflective surface of the background assembly.

13. The method of claim 12, further comprising covering the socket assembly of the bulb assembly with a reflective surface having characteristics similar to the sturdy background assembly.

14. The method of claim 12, further comprising positioning a pair of wires of the light system into a grip of extending member for further securing the bulb assembly to the background assembly.

15. The method of claim 14, wherein the extending member receives the pair of wires of the light assembly on an opposing side of the background assembly for securing the bulb assembly to the background assembly, and for hiding the pair of wires from view.

16. The method of claim 12, further comprising providing a frame assembly having a frame for supporting the background assembly.

17. The method of claim 12, further comprising positioning a support member behind the background assembly for providing additional support, such that the support member is connected to the background assembly.

* * * * *